United States Patent [19]

Phillips

[11] Patent Number: 4,475,257

[45] Date of Patent: Oct. 9, 1984

[54] WAVE MOTION ABSORBER FOR WATER BED MATTRESSES

[76] Inventor: Raymond M. Phillips, 2566 Tuna Canyon Rd., Malibu, Calif. 90290

[21] Appl. No.: 342,738

[22] Filed: Jan. 26, 1982

[51] Int. Cl.[3] ..... A47C 27/08

[52] U.S. Cl. ..... 5/450; 5/451

[58] Field of Search ..... 5/451, 452, 455, 450, 5/422

[56] References Cited

U.S. PATENT DOCUMENTS 4,325,152 4/1982 Carpenter ..... 5/451

4,399,575 8/1983 Hall ..... 5/450

*Primary Examiner*—Alexander Grosz

*Attorney, Agent, or Firm*—William H. Maxwell

[57] ABSTRACT

A free floating wave motion absorber confined within a water bed mattress for firm body support with omni-directional rate control over motion, so that disturbing movements are substantially reduced and virtually eliminated, by a multiplicity of circulation cells that individually restrict both downward and upward water flow, retard depression or sudden bottoming, and that co-act jointly to transfer lateral displacement forces.

21 Claims, 14 Drawing Figures

WAVE MOTION ABSORBER FOR WATER BED MATTRESSES

BACKGROUND

Water beds are comprised of a frame that carries a liquid filled envelope upon which persons recline. The frame includes a platform having the plan configuration desired, and upstanding side and end walls that confine the overlying mattress to said plan configuration. Flat plastic sheet is employed in the mattress construction, folded and/or seam welded together in a rectangular envelope formation with a fill opening adapted to be closed. The envelope is filled with a heavy liquid such as water, whereby a person reclining is supported by means of flotation as result of displacement.

In a basic water bed mattress as thus far described, there is an absence of means to prevent wave motion, and as a result continued sloshing is a characteristic disadvantage which adversely affects a number of persons who cannot tolerate it. Heretofore, various arrangements for surge control have been proposed, but with complexity and at considerable expense. Also, disturbing movements often result from the change in position of one person to the disadvantage of another, with reference to sleeping partners. Therefore, it is a general object of this invention to provide a simplified means for most effectively damping out wave motion in liquid filled mattresses.

Flotation mattresses of the type here under consideration have been compartmented for flow restriction, the multiplicity of compartments and their attachment to the outside envelope being complicated and costly, it being an object of this invention to provide a detached compartmented means which damps wave motion, all without fastening to the plastic walls of the mattress envelope which heretofore was thought to be necessary. With the present invention, a detached free floating Wave Motion Damper is positioned by flotation within the outside envelope, to carry depending curtains that are comprised of depending cells that control and impede wave motion.

The usual sheet material employed in constructing this wave motion damper is of greater molecular weight than that of the water in which it is to float (some are of lesser weight). Therefore, it is an object of this invention to provide flotation means that suspends said detached compartmented means within the confines of the water bed mattress interior. In practice, a plate of material having lesser weight than the water which it displaces is free to float within each compartment, thereby engaging the top of the compartment to lift the water motion damper within the confines of the mattress interior. Bouyancy of the plates is controlled by varying the displacement thereof, and accordingly the thickness of said plates vary as later described.

Each compartment of the wave motion damper carries a plate of flotation material, it being an object of this invention to utilize said plate to gain a valving action for vertical flow control of water by restricting either or both downward and upward movement of said water. In practice, the plates and/or the top panels of the compartments are ported as will be described.

It is the phenomenon of wave motion in heavy liquid such as water with which the present invention is primarily concerned. In practice, when a person applies his or her weight onto the top surface of a water bed mattress, sudden displacement as is required by flotation of that person causes liquid motion with inertia from the position of that person, in the form of radiating waves moving in all directions. These waves move horizontally and reflect from the sides and end walls of the mattress which are backed by the hard structural retaining walls of the frame, and it is these waves which this invention hastens to dissipate and/or absorb. Accordingly, it is an object of this invention to substantially reduce and to virtually eliminate the direct as well as reflective wave motion in liquid filled mattresses. As will be described, a substantial proportion of the water bed mattress interior is occupied by the said controlling compartments, so as to intercept and impede omnidirectional wave motion generated by body displacements of persons applying themselves to or removing themselves from the mattress.

The wave motion which is to be stopped involves the liquid mass of water which is a heavy liquid. As the water is displaced, the fluid particles thereof also move laterally commensurate with the amount of depression, and said fluid particles return again when displacement is removed. The phenomenon of wave motion responds to the proximity or depth of the confining bottom, and the fluid particles transfer motion to adjoining fluid particles, as waves radiate and/or progress, and so on. Consequently, the motion of a given fluid particle is circular and more often or more accurately elliptical. Accordingly, it is an object of this invention to provide a wave motion damper that restricts and damps the circular and/or elliptical fluid movements. It is a feature of this invention that the compartments retard and restrict the said circular and/or elliptical movement effect of the wave motion by which wave energy is normally transmitted.

It is an object of this invention to advantageously utilize hydraulic effects to control the rate and extent of mattress depression, and to this end the liquid control ports are varied in aperture size according to forces applied. Larger port openings are provided for facilitating motion, whereas smaller port openings are provided for restraining motion. A feature is the gradual closure of the flow controlling ports; firstly the closure of primary ports followed by the closure of secondary ports. It is the nature of plastic sheet material to make a fluid tight seal, with flap engagement as herein disclosed; so that subsequent to a gradual or sequential closing of the ports, a limit of mattress depression is effectively established.

SUMMARY OF THE INVENTION

This invention relates to water bed mattresses and a wave motion damper therefor, characterized by free floating confinement of said damper within the confines of the mattress interior. The wave motion damper is comprised of a multiplicity of fluid controlling compartments in which floating valve plates operate to restrict downward and/or upward movement of the liquid as it is displaced. A substantial portion of the mattress area is occupied by the multiplicity of compartments, and in the preferred embodiment the compartments are in touching engagement one with the other so that the damping energy is transferred by one through the other to dissipate motion throughout the mattress. The flotation plates are ported, as are the top and bottom panels of the compartments, the said multiplicity of compartments being tied together as a unit by integral top panels comprised of a single sheet of material.

The foregoing and other various objects and features of this invention will be apparent and fully understood from the following detailed description of the typical preferred forms and applications thereof, throughout which description reference is made to the accompanying drawings.

Figure 4:
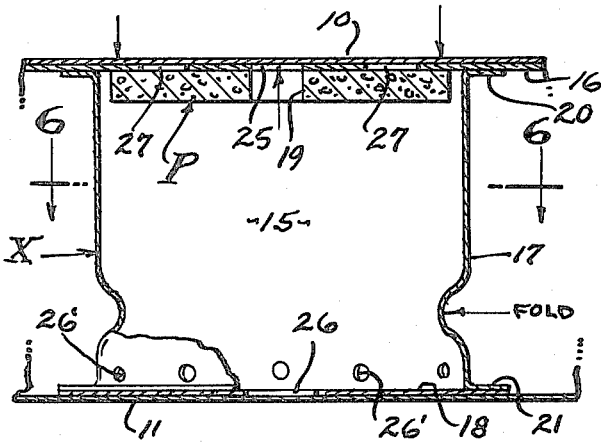
FIG. 4 is an enlarged detailed sectional view showing the damper shut off to bottom flow and taken as indicated by line 4—4 on FIG. 3.
Figure 5:
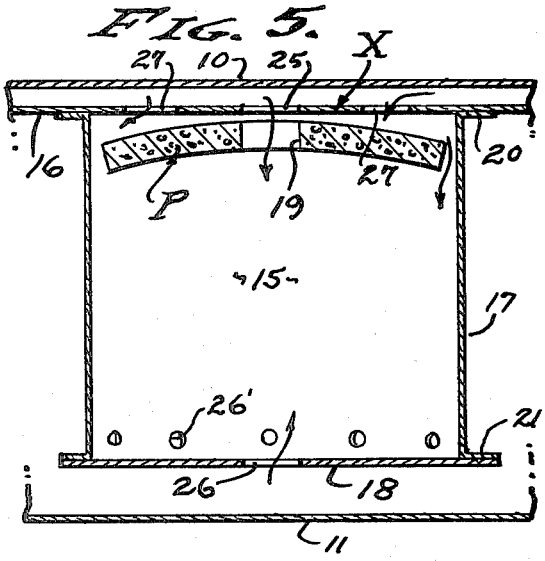
Figure 4A:
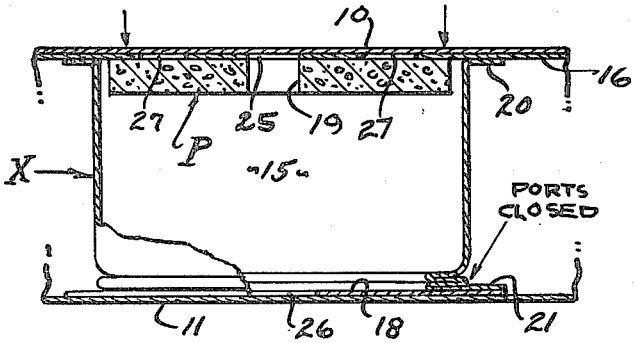

FIG. 4*a* is a view similar to FIG. 4 to show the damper shut off from both bottom and lateral flow, and FIG. 5 is a similar view showing the valve action of the flotation plate.

Figure 6:
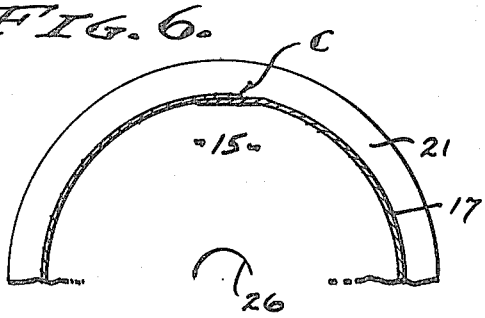

FIG. 6 is a half section of a single compartment and taken as indicated by line 6—6 on FIG. 4.

Figure 7:
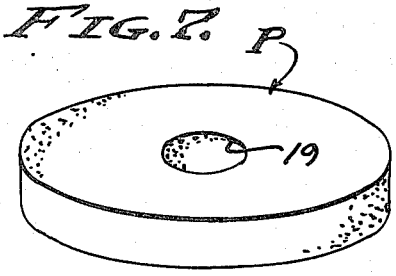
Figure 7A:
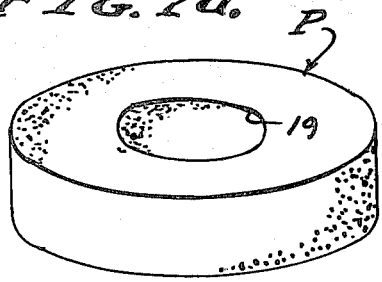

FIG. 7 is a perspective view of a single flotation plate with a small valve port and FIG. 7*a* is a similar view with a large valve port and increased flotation.

Figure 1:
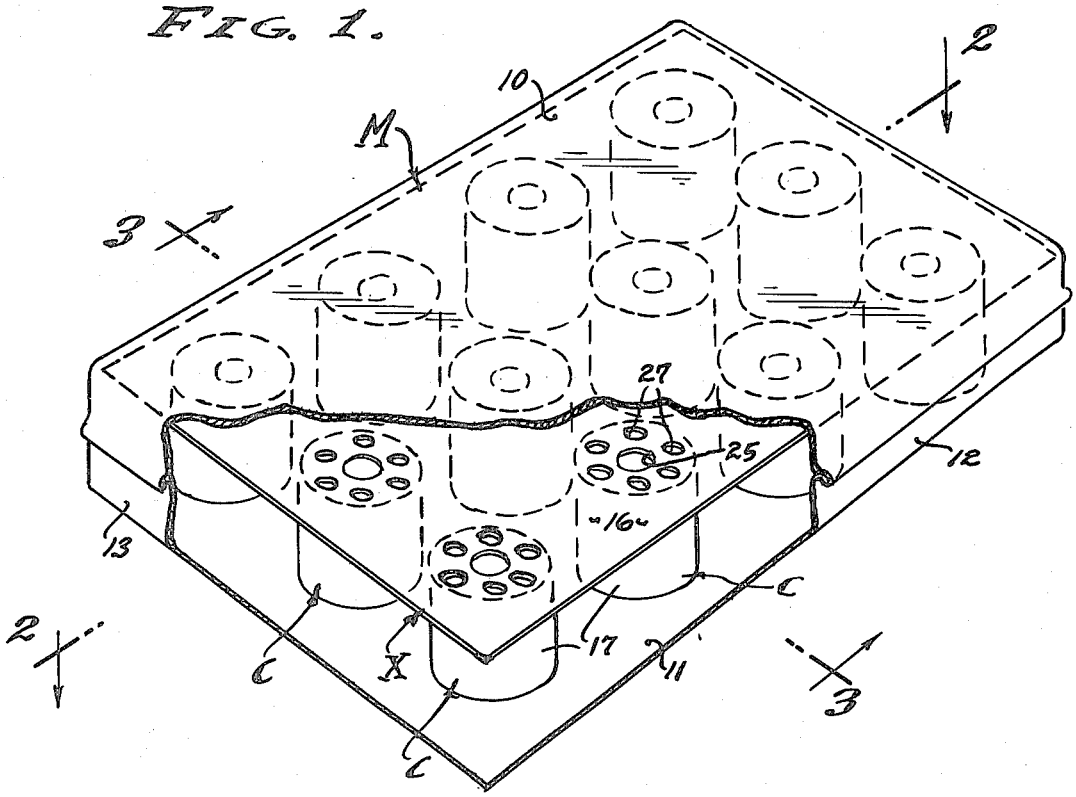
FIG. 1 is a perspective view of a water bed mattress with portions broken away to reveal the free floating wave motion damper of the present invention.
Figure 2:
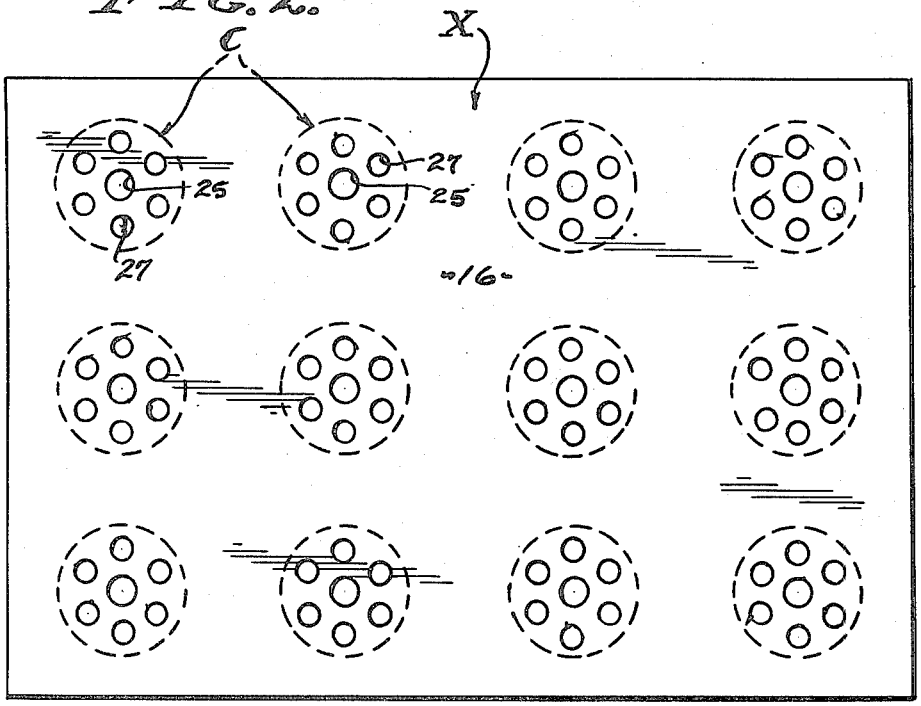
FIG. 2 is a top plan view of the free floating wave motion damper, removed from the mattress interior, and taken as indicated by line 2—2 on FIG. 1.
Figure 8:
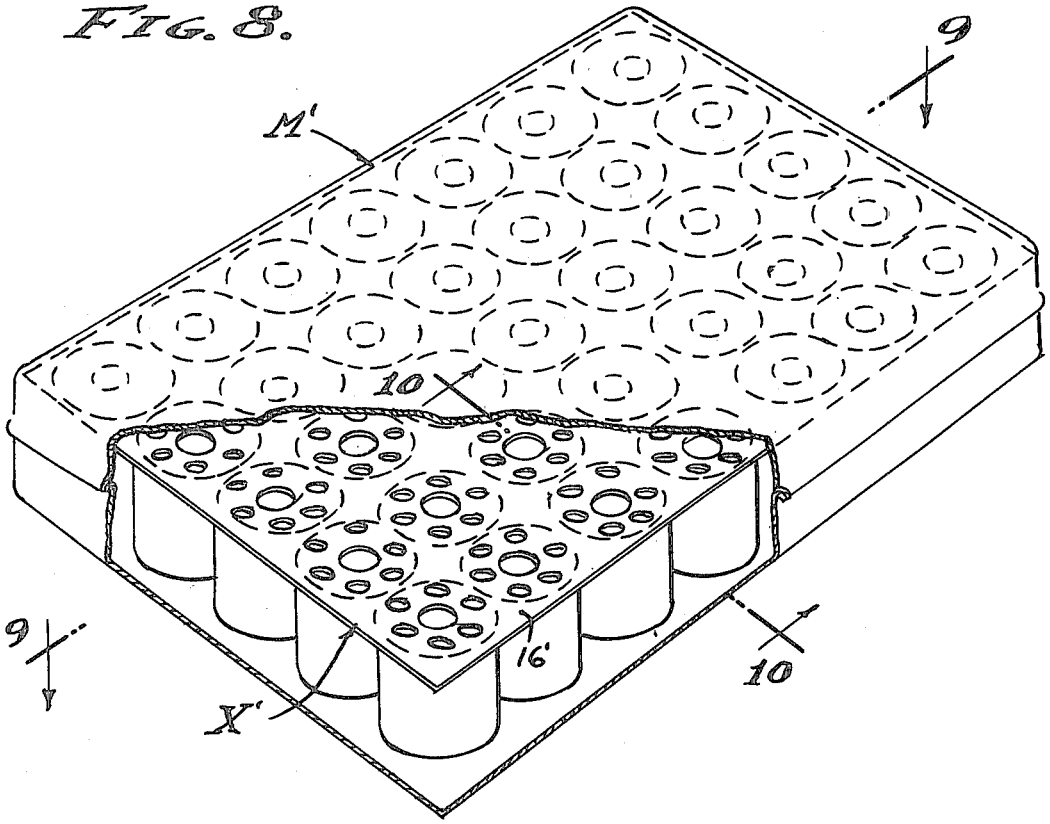

FIG. 8 is a view similar to FIG. 1 and shows a second and preferred embodiment of the present invention.

Figure 9:
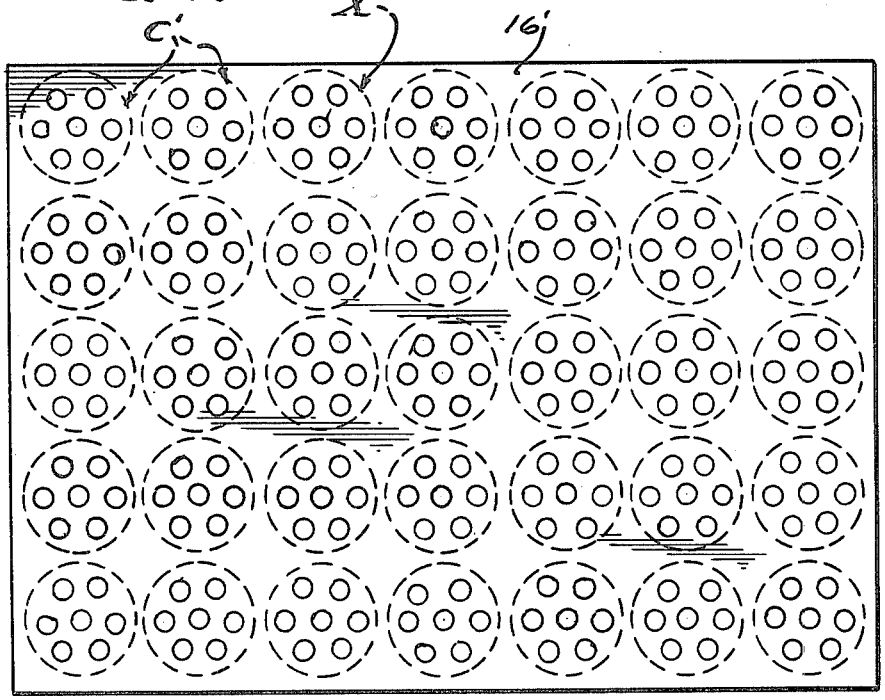

FIG. 9 is a top plan view of the free floating wave motion damper of the preferred embodiment and taken as indicated by line 9—9 on FIG. 8.

Figure 10:
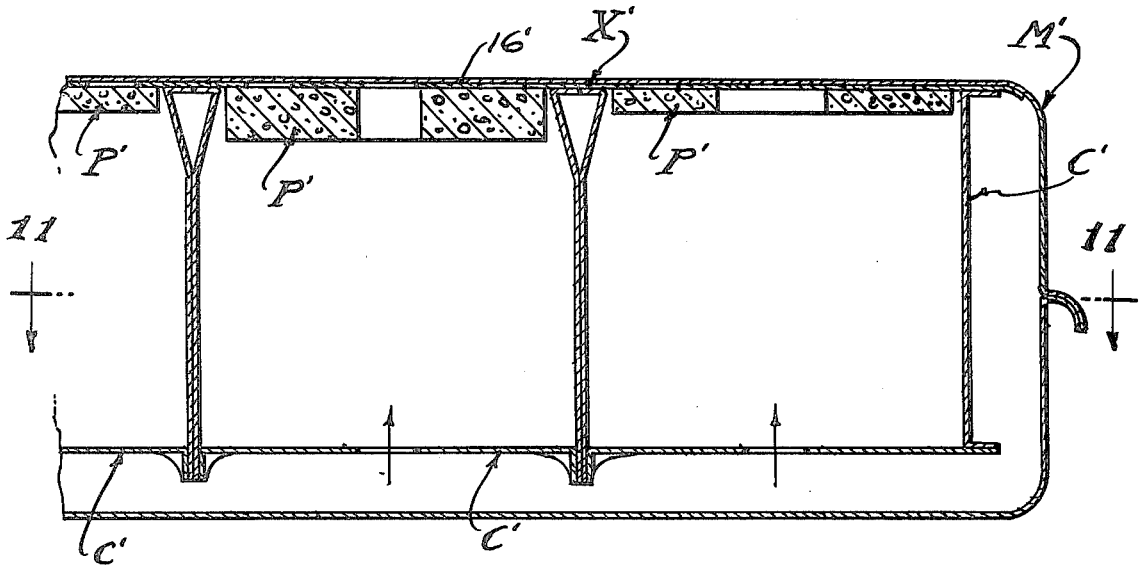
Figure 11:
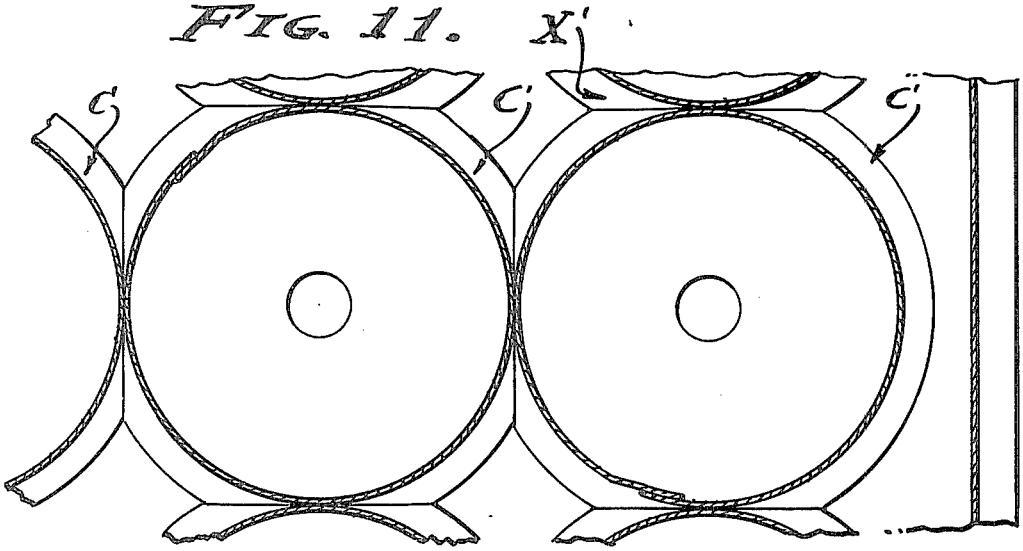

FIG. 10 is an enlarged transverse sectional view taken as indicated by line 10—10 on FIG. 8, and FIG. 11 is a plan section of cooperating compartments and taken as indicated by line 11—11 on FIG. 10.

Figure 12:
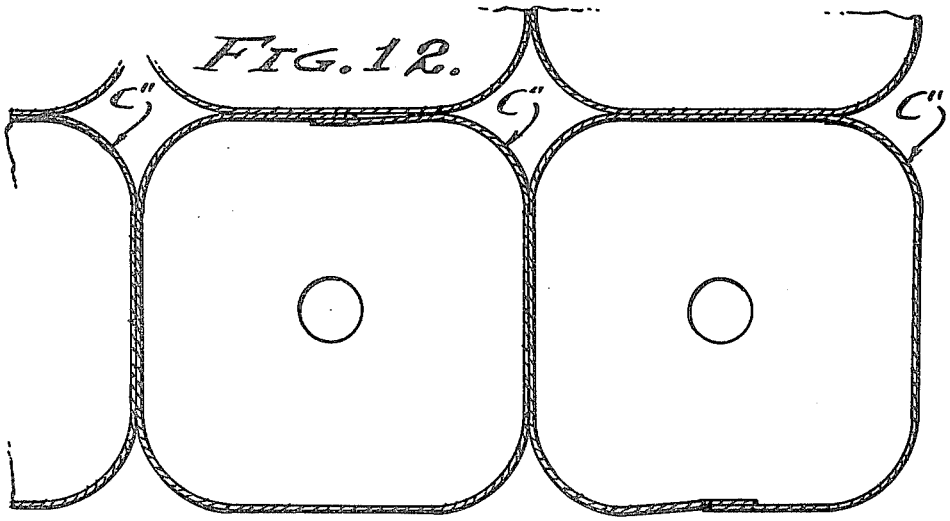

FIG. 12 is a view similar to FIG. 11 and shows a third embodiment of the invention.

PREFERRED EMBODIMENT

Referring now to the drawings, this invention involves a basic flotation mattress structure M comprised of an envelope of thin flexible and supple plastic sheet material such as polyvinylchloride. The mattress M is rectangular in plan configuration and is characterized by flat, horizontal and vertically spaced top and bottom panels 10 and 11, and flat vertical side and end panels 12 and 13 formed as continuations of and extending between the perimeters of said top and bottom panels. The several walls or panels 10–13 are welded or joined together, as shown, to establish a sealed and water-tight bladder or envelope.

The basic mattress structure M described briefly above can, for example, be made or established in accordance with the teaching of U.S. Pat. No. 4,125,975 for WATER BED MATTRESS issued May 31, 1977 to Raymond M. Phillips and William J. Pease. The details of construction and the manufacturing techniques employed in making the above described mattress can be varied widely, since the free floating wave motion damper unit X of the present invention is in practice detached and simply accommodated therein. Accordingly, this disclosure need not and does not burden the reader with any further illustration and description other than that described above concerning the mattress structure M.

The wave motion damper unit X is a unit of construction fabricated of 24 gauge polyvinylchloride plastic, of 0.024 inch thickness, and which is a strong and pliable material, pieces of which are adapted to be fixedly joined together by means of heat welded seams. The molecular weight of said plastic is slightly greater than that of the water into which it is immersed. The said sheet plastic is fabricated into cells C that carry flotation plates P and that control vertical movement of the liquid in which the entire damper unit X is immersed. There is a multiplicity of cells C establishing flow control compartments 15 in which the plates P operate as valves while supporting a top panel 16 from which the cells C depend to within close proximity of the bottom 11 of mattress M. The top panel 16 is of the same plan configuration as that of the mattress M and the cells C are evenly distributed throughout the mattress area and secured in place to the coextensive top panel 16.

In the first embodiment of FIGS. 1–7 a proportionate area of the mattress M and top panel 16 is occupied by the multiplicity of cells C which do not touch each other. However, the cells C are in close proximity so that one influences the other. That is, a restriction of liquid motion by one cell limits wave motion or energy transmitted to the next adjacent cells. In this first form the cells are spaced approximately two diameters on center, for example and assuming that they are round in configuration. Therefore in practice, a typical water bed mattress will have three cells C transversely and four cells C longitudinally, or a total of twelve cells C, and all of which are attached to and depend from the top panel 16.

The cells C are alike so that a description of one will suffice for all, and as best illustrated in FIGS. 4 and 6 of the drawings, the cell C involves a tubular wall 17 of sheet plastic secured to and depending from the top panel 16, and with a bottom panel 18 closing the tube form to establish the compartment 15. The cell material is slightly heavier than water as above specified. As shown, the cell C is a cylinder with its perimeter wall 17 secured to the bottom face of top panel 16 by means of a peripheral flange 20 secured thereto as by a heat welded seam. Likewise, the perimeter wall 17 is secured to the bottom panel 18 by means of a peripheral flange 21 also secured thereto as by a heat welded seam. The heat welded seams are continuous so that joinder of these parts is leakproof. However, and prior to this seam welding of either the top or bottom panel, the flotation plate P is inserted therein as shown.

The flotation plate P is fabricated of a floating material such as polyethelene foamed plastic, for example of ¼ inch cross sectional thickness, having a low density for substantial bouyancy and of considerable structural integrity and/or rigidity, yet pliable and adapted to be warped and bent out of its normal planar condition, and so that its corner edges are soft and depressible. Warping and bending of these plates P is therefore without destruction thereto, and is conducive to conformation to the body contours of persons reclining upon the mattress M. A feature is that each flotation plate P rises to the top of the compartment in which it is carried, to supportably engage the underside of the top panel 16. The plates are varied in thickness as shown in FIGS. 3, 7–8 and 10, in order to increase or decrease bouyancy as may be required. As shown, the plan configuration of the plate P is the same as, or slightly smaller than, the inside configuration of the tubular cell wall 17, preferably having some clearance therein so as to be free moving and for liquid passage therearound. A feature is the central port 19 through plate P and which is in open communication with a central port 25 in top panel 16, as next described.

In accordance with this invention, the cells C are ported for vertical circulation of liquid therethrough, and to this end there is a central port 25 in the top panel 16 and a port 26 in the bottom panel 18. The ports 25 and 26 are primary ports that provide a metered flow which controls the rate of depression. That is, the rate at which the cell can collapse downwardly until flow is restricted by the at least one bottom port 26. A feature is the initial spacing of the cell bottom panel 18 above the bottom 11 of the mattress M. Accordingly, initial depression of the cell is with the least restriction, and with increased restriction as the bottom 11 is approached and a maximum when the bottom panel 18 engages the bottom 11 to close the ports 26 partially or completely. As the panel 18 approaches bottom 11, the liquid flow is gradually decreased. Note in particular that the displacement of liquid is confined within the compartmented cell C and that flow is vertical and discharged downwardly so as to flow outward and then upwardly around the cell C.

Figure 3:
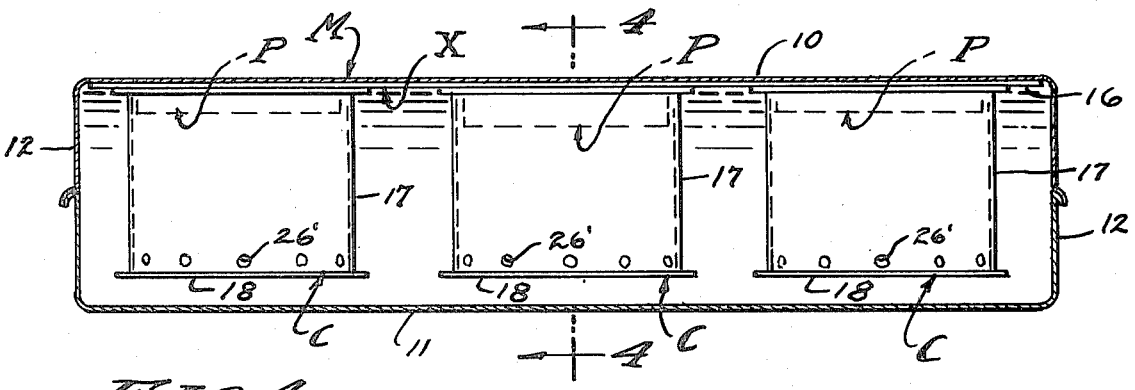
FIG. 3 is an enlarged transverse section view taken as indicated by line 3—3 on FIG. 1.

Supplementary to the gradual closure of the primary port or ports 26 as above described, there is the subsequent gradual closure of more restrictive secondary ports 26'. In practice, the secondary ports 26' are damping ports through the perimeter wall 17, located immediately above the peripheral flange 21 and subject to being closed by collapse and/or folding of the perimeter wall, as best illustrated in FIG. 4*a*. When the primary port 26 is closed, the liquid discharge is confined to the series of peripheral ports 26' as shown in FIGS. 3 to 4*a*, whereupon folds develope in the perimeter wall 17 which then gradually close the ports 26', as the wall collapses adjacent to the bottom flange 21.

The flotation plate P has a valving action as best illustrated in FIGS. 4 and 5 of the drawings, essentially a check valve that restricts upward flow, and conversely unrestricted downward flow. It is the flow through ports 25 and 26 hereinabove described that is controlled. In practice, additional ports 27 are provided in the top panel 16 surrounding the port 25 therethrough and within the boundaries of the perimeter wall 17. Whereas downward pressure and/or movement as shown in FIG. 4 closes the ports 27 by virtue of the rising plate P that flattens itself against the panel 16, movement as shown in FIG. 5 opens the ports 27 by virtue of hydraulic flow that depresses the plate and thereby opens ports 27 with downward deflection of the plate perimeter, as indicated in FIG. 5 to increase flow capability. Consequently, downward flow is less restricted so as to have rapid recovery of the damper unit X to a normal planar condition, at any one of the cells C. As the panel 18 retracts from the bottom 11, the liquid flow is gradually increased through port 26 and downward flow through ports 25 and 27 is confined within the compartmented cell C, and through flow is essentially vertical and downward through ports 25 and 27 to fill the compartment to capacity.

From the foregoing it will be seen that the vertical flow of liquid through cells C is confined within the outside perimeter or tubular wall 17, and consequently lateral movement of the liquid is stopped and restricted by the limited inflation of the cell wall 17. Since the cell retains its full diameter when panel 16 is depressed with random folds as in FIG. 4, there is no wave motion transmitted beyond the perimeter wall 17 when in that condition. As and when the panel 16 recovers to its full planar height, the unrestricted entry of liquid into the cell C is vertical through ports 19, 25, 26 and 27, as in FIG. 5 to re-establish full height of the cell. There is a vertical collapse and inward folding of wall 17 as indicated in FIG. 4, while the full diameter of the cell C is otherwise retained. Consequently, very little lateral wave energy is transmitted radially from the cell C.

In the preferred and second embodiment of FIGS. 8–11, a greater proportionate area of the mattress M' and top panel 16' is occupied by the wave motion damper X' having a multiplicity of cells C' which closely approach and/or actually touch each other as they are initially placed. The cells C' are closely spaced so as to come into touching engagement and so that one influences the other. In this second form the cells are spaced approximately one diameter on centers (for round cells). Therefore in practice, a typical water bed mattress will have five cells C' transversely and seven cells C' longitudinally, or a total of 35 cells C', and all of which are attached to and depend from the top panel 16'.

The cells C' and plates P' are shown in the identical form as the cells C and plates P hereinabove described, it being understood that the number and arrangement of cells and flotation plates can vary as circumstances require. In the preferred second embodiment, the cells C' substantially occupy the greater area of the mattress M' and are placed so as to engage tangentially. In practice, adjacent cells C' depress laterally one against the other (see FIG. 12). Accordingly, the cells C' are adapted to be deflated through lateral depression and liquid exhausted therefrom as shown in FIG. 4. However and conversely, the cells C' are also adapted to be inflated only to a full diameter such as that shown in FIG. 11, or under some circumstances to a condition such as shown in FIG. 12 where closely adjacent cells C'' restrict inflation. It is to be understood that placement of the cells C' on the top panel 16' can be such that said cells are initially touching, or substantially so, so that a greater area of the water bed mattress is occupied by the controlling cells.

From the foregoing it will be seen that I have provided dynamic control of omni-directional wave motion generated within water bed mattresses, by restricting lateral transmission of wave energy with collapsible cells that meter vertical displacement of liquid. With the present invention there is a dimensional limit built into each cell which stops lateral movement of the liquid, while liquid displacement is controlled at restricted rates determined by the flotation plates that suspend the cells in working position. The wave motion damper unit X (X') is simply placed within the mattress M (M') and is enclosed therein in its collapsed condition for packaging and shipping. Upon inflation of the mattress with water, the free floating unit X (X') assumes a planar condition with the top panel 16 (16') carried by the flotation plates P (P') and the top mattress panel 10 supported thereby. All material employed in the construction is supple and pliable so that the presence of the cells within the mattress is imperceptible and without obstruction to depression of the mattress panel 10. A feature is that "bottoming" of the top mattress panel 10 against the bottom panel 11 is prevented, by closure of the ports 26 against the bottom panel 11, as the cells support the top panel 10 and may or may not be slowly deflated dependent upon the depressive force applied.

Having described only the typical preferred forms and applications of my invention, I do not wish to be limited or restricted to the specific details herein set forth, but wish to reserve to myself any modification or variation that may appear to those skilled in the art as set forth within the limits of the following claims.

I claim:

1. In combination, a flotation mattress comprised of an envelope of supple sheet material with a top body supporting panel and filled with liquid, and a free floating wave motion absorber unit detached from and adapted to seek a proper operating position interiorly of the mattress envelope;

said free floating wave motion absorber unit including, a top end panel of supple sheet material and of the same plan configuration as the body supporting panel of the mattress envelope, a multiplicity of vertically disposed tubular cells of supple sheet material with side walls depending from and closed at the top end thereof by the top end panel and at the bottom thereof by bottom end panels, a flotation plate of low density material carried within the cell to float free therein and to support the same proximate to the top body supporting panel of the mattress envelope, and there being a port through at least one end of the tubular cell engageable with the mattress envelope for restricted vertical liquid flow therefrom, whereby liquid motion is restricted by the limit of the tubular cell walls to absorb wave energy.

2. The combination of a mattress and wave motion absorber unit as set forth in claim 1, wherein the top ends of the cells have said port therethrough.

3. The combination of a mattress and wave motion absorber unit as set forth in claim 1, wherein the bottom end panels of the cells have said port therethrough.

4. The combination of a mattress and wave motion absorber unit as set forth in claim 1, wherein both the top end and bottom end panels of the cells have said port therethrough.

5. The combination of a mattress and wave motion absorber unit as set forth in claim 1, wherein the top ends of the cells have said port therethrough, there being a port through each flotation plate and in alignment with a port through the top end of each cell for restricted vertical liquid flow.

6. The combination of a mattress and wave motion absorber unit as set forth in claim 1, wherein the top ends of the cells have at least one port therethrough normally closed by the flotation plate to prevent upward flow and opened by downward flow to permit liquid circulation.

7. The combination of a mattress and wave motion absorber unit as set forth in claim 1, wherein the top ends of the cells have said port therethrough, there being a port through each flotation plate and in alignment with a port through the top end of each cell for restricted vertical liquid flow, and wherein the tops of the cells have at least another port therethrough normally closed by the flotation plate to prevent upward flow therethrough and opened by downward flow to augment liquid circulation.

8. The combination of a mattress and wave motion absorber unit as set forth in claim 1, wherein the top ends of the cells have said port centrally therethrough, there being a port through each flotation plate and in alignment with a port through the top end of each cell for restricted vertical liquid flow, and wherein the top of each of the cells has a plurality of ports surrounding the first mentioned central port and normally closed by the flotation plate to prevent upward flow therethrough and opened by downward flow to augment liquid circulation.

9. The combination of a mattress and a wave motion absorber as set forth in any of claims 6 through 8, wherein the flotation plate is of flexible material adapted to flex away from the top end panel.

10. The combination of a mattress and a wave motion absorber as set forth in any one of claims 1 through 8, wherein the top ends of the multiplicity of cells are integral in the top end panel comprised of a single sheet of said supple sheet material.

11. The combination of a mattress and a wave motion absorber as set forth in any of claims 1 through 8, wherein the bottom end panels of the tubular cells are engageable with a bottom panel of the mattress envelope.

12. The combination of a mattress and a wave motion absorber as set forth in any of claims 1 through 8, wherein the multiplicity of wave motion absorber cells are in laterally spaced relation with respect to each other.

13. The combination of a mattress and a wave motion absorber as set forth in any of claims 1 through 8, wherein the multiplicity of wave motion absorber cells are in laterally touching relationship one with the other.

14. The combination of a mattress and a wave motion absorber as set forth in any of claims 1 through 8, wherein the multiplicity of wave motion absorber cells are laterally depressed one against the other.

15. The combination of a mattress and wave motion absorber unit as set forth in claim 1, wherein the side walls of the cells have laterally open ports more restrictive than the at least one bottom end panel port for damping motion when said end panel port is engaged with a bottom panel of the mattress envelope.

16. The combination of a mattress and wave motion absorber unit as set forth in claim 1, wherein the side walls of the cells have laterally open ports more restrictive than the at least one bottom end panel port and located immediately above the bottom end panel for increasing damping motion by gradual closure through collapse and folding in of said side walls when said cells engage with and depress against a bottom panel of the mattress envelope.

17. The combination of a mattress and wave motion absorber unit as set forth in claim 1, wherein the bottom end panels of the cells have said port therethrough, and wherein the side walls of the cells have laterally open ports more restrictive than the at least one bottom end panel port and located immediately above the bottom end panel for increasing damping motion by gradual closure through collapse and folding in of said side walls when said cells engage with and depress against a bottom panel of the mattress envelope.

18. The combination of a mattress and wave motion absorber unit as set forth in claim 1, wherein the top end panels of the cells have said port therethrough, there being a port through each flotation plate and in alignment with a port through the top end of each cell for restricted vertical liquid flow, and wherein the side walls of the cells have laterally open ports more restrictive than the at least one bottom end panel port and located immediately above the bottom end panel for increasing damping motion by gradual closure through collapse and folding in of said side walls when said cells engage with and depress against a bottom panel of the mattress envelope.

19. The combination of a mattress and a wave motion absorber as set forth in any of claims 1 through 18, wherein the bottom end panels of the tubular cells are normally spaced from and engageable when depressed with a bottom panel of the mattress envelope.

20. The combination of a mattress and wave motion absorber unit as set forth in claim 1, wherein the flotation plates are of greater displacement and buoyancy in selected areas of the mattress for increased firmness of the mattress at said areas.

21. The combination of a mattress and wave motion absorber unit as set forth in claim 1, wherein the top ends of the cells have said port therethrough, there being a port through each flotation plate and in alignment with a port through the top end of each cell for restricted vertical liquid flow, and wherein the said ports through the top end panels and plates are of more restrictive aperture in related areas for increased motion damping of the mattress depression at said areas.

* * * * *